United States Patent [19]

Stageboe et al.

[11] 4,043,138

[45] Aug. 23, 1977

[54] OFFSHORE FOUNDATION STRUCTURE

[75] Inventors: Jan Stageboe, Oslo; Tomas Berge Einstabland, Asker, both of Norway

[73] Assignee: Ingenior F. Selmer A/S, Oslo, Norway

[21] Appl. No.: 667,923

[22] Filed: Mar. 17, 1976

[30] Foreign Application Priority Data

Mar. 21, 1975 Norway ..... 750982

[51] Int. Cl.[2] ..... E02B 17/00; F02D 23/02

[52] U.S. Cl. ..... 61/88; 61/87; 61/86

[58] Field of Search ..... 61/46.5, 46, 86–104; 114/.5 D, 26, 43.5

[56] References Cited

U.S. PATENT DOCUMENTS

| | | | |
|---|---|---|---|
| 3,289,419 | 12/1966 | McGowen | 114/.5 D X |
| 3,412,564 | 11/1968 | McClintock | 61/46.5 |
| 3,540,396 | 11/1970 | Horton | 114/.5 D |
| 3,577,946 | 5/1971 | Horton | 61/46.5 X |
| 3,815,372 | 6/1974 | Mott | 61/46.5 |
| 3,927,535 | 12/1975 | Giblon | 61/46.5 |

*Primary Examiner*—Dennis L. Taylor

*Attorney, Agent, or Firm*—Ladas, Parry, Von Gehr, Goldsmith & Deschamps

[57] ABSTRACT

The invention relates to an open frame offshore foundation structure of concrete to be firmly but removably located on the sea floor. The structure comprises a lower set of hollow columns inclined towards each other in direction upwards, a ballastable intertie box structure rigidly receiving the tops of said inclined columns and an upper vertical column unit, the lower ends of which are rigidly connected to the intertie box structure and the upper end of which shall support a working platform in position above sea level.

9 Claims, 4 Drawing Figures

OFFSHORE FOUNDATION STRUCTURE

The present invention relates to an offshore or marine foundation or platform concrete structure of the type designed to be more or less permanently fixed to the bottom floor of an offshore body of water. More particularly, the invention relates to a submersible foundation of platform open frame concrete structure designed for relatively large water depths, for instance depths from 200 meters up to 400 meters or more.

BACKGROUND OF THE INVENTION

The structure in accordance with the present invention is in many respects a further development of earlier foundation structures developed by the applicants. Both the earlier constructions and the present invention relate to structures comprising a number of substantially vertically disposed columns rigidly interconnected with cross-members and forming support for a working platform.

Applicants' earlier platform structures and other known designs have been assumed adequate for sea depths up to 200 meters. With larger depths these earlier designs are however neither technically nor economically assumed adequate. With depths exceeding 200 meters one has hitherto used assumed floating structures as the only or the best solution, and platform structures of the so-called semi-submersible type are most usual, and such structures are therefore also used in a large degree in connection with drilling and production of offshore gas and oil sources.

The main reason for that submersible foundations and platforms have been considered without interest for depths from 300 to 400 meters, is obviously that such structure necessarily will attain almost prohibitive dimensions. Fact is, however, that the size itself implies today not a design obstacle. The structures, particularly made in concrete, must however necessarily be made ashore or along the shore, and thereafter be barged or floated out to the predetermined location and be sunk down in correct upright position. Extensive investigations have shown that the building as well as the barging of such large structures will imply large difficulties. Firstly, the structure as such will demand larger great sea depths at the building site and furthermore the depth during the travel from the building site to the final offshore location must necessarily have the same barging depth. When the structure shall be for instance 300 to 400 meters high, it may be necessary to barge the structure in horizontal or tilted over position. The structure being erected to vertical position on the site of location. In this case, number of problems will arise in connection with the stability, buoyancy and furthermore in connection with the erection and submersion and positioning of the structure on the offshore site. It has been proposed to make such foundation structures in sections with assembling on the site of location, but hitherto no dependable solutions have been presented. Furthermore, one has evaluated various forms of auxiliary means such as barges, floats, buoyancy tanks, in order to provide the necessary buoyancy and stability during the barging and submerging operation. Technical solutions to solve the problems in this way are fully possible, but in addition to be rather complicated they fall much too expensive in order to be economically attractive.

Another essential problem with foundations for such depths concerns the stability when a such high structure is exposed and subjected to the impacts from winds, streams, waves, erosions, etc.

A special problem is to obtain sufficient stiffness and strength within the concept of using an open frame structure design.

A main object of the present invention is therefore to provide an improved design for an offshore foundation structure made in concrete and attractive for depths from for instance 300 to 500 meters and which design can be attractive from a point of view of economy, stability and simplicity in design.

A further object of the invention is to provide a design which makes it possible to keep the width of the structure and also the total weight of same within reasonable values and still to obtain the required strength and stability on site without requiring further stabilization means such as guylines substratum foundations etc.

A further object of the invention is to provide a design which renders it possible to adapt the design to various sea depths for instance in the range of 300 to 500 meters.

A special object of the invention is to provide a design which can make it comparatively easy to barge the structure out in horizontal position to the site of location and carry out the erection and submersion of the structure with minimum requirements to auxiliary buoyancy means etc.

The foundation structure in accordance with the invention is designed to rest firmly on the sea floor in offshore position and it comprises a rigid open frame structure of concrete including at least three upright supporting columns, the lower portions of which are rigidly interconnected with cross members and which uppermost are supporting a working platform in position above sea level, and the structure in accordance with the invention is characterized in that it comprises a lower set of columns arranged with an incline and an upper set of columns extending vertically up to the working platform, the lower set of columns and the upper set of columns being interconnected by means of a rigid box structure or intertie, said box structure or intertie constituting a ridgifying interlink between the lower and upper set of columns and furthermore providing added buoyancy and stability to the foundation structure.

In a preferred embodiment the lower and upper set of circular columns are three in number and arranged as an equilateral triangle when viewed in plan view, i.e. a tripod structure.

In a further embodiment the intertie is composed of self-contained box girders having a through-going opening in the centre zone. In a further preferred embodiment, from the working platform all the way down to the bottom of the structure extends a vertical column primarily serving as a downlead or conductor for drilling equipment, oil and gas piping etc.

In a further preferred embodiment also the cross members connecting the columns at the bottom of the lower set of columns are formed as a box structure similar to the intertie between the lower and upper set of columns. In this preferred embodiment the lower columns are furthermore in per se known fashion provided with frusto-conical enlarged footings, giving the structure an increase in the effective biasing width and thus the stability.

The structure in accordance with the invention possesses a number of advantages and meets most of the aims and requirements forming the object of the invention. A special advantage is that the lower part of the foundation structure including the intertie structure can be made as a standard or module unit having more or less fixed dimensions, while the number, dimension and particularly the height of the upper set of vertical columns can be varied to adapt the structure varying sea depths within a certain depth range.

A special advantage with the foundation structure in accordance with the invention is that it will have improved stability in semi-submerged, floating position due to the buoyancy of the intertie, a quality which makes it possible to locate more loads on the platform such as pumps, oil production equipment etc. When the foundation structure shall be floated to site in upright position this is a large advantage since it reduces the necessity for mounting such equipment on site. Experience has shown that on site mounting falls very costly and difficult.

DESCRIPTION OF THE DRAWINGS

A preferred embodiment of a foundation structure in accordance with the invention shall be further described with reference to the attached drawings, wherein.

Figure 1:
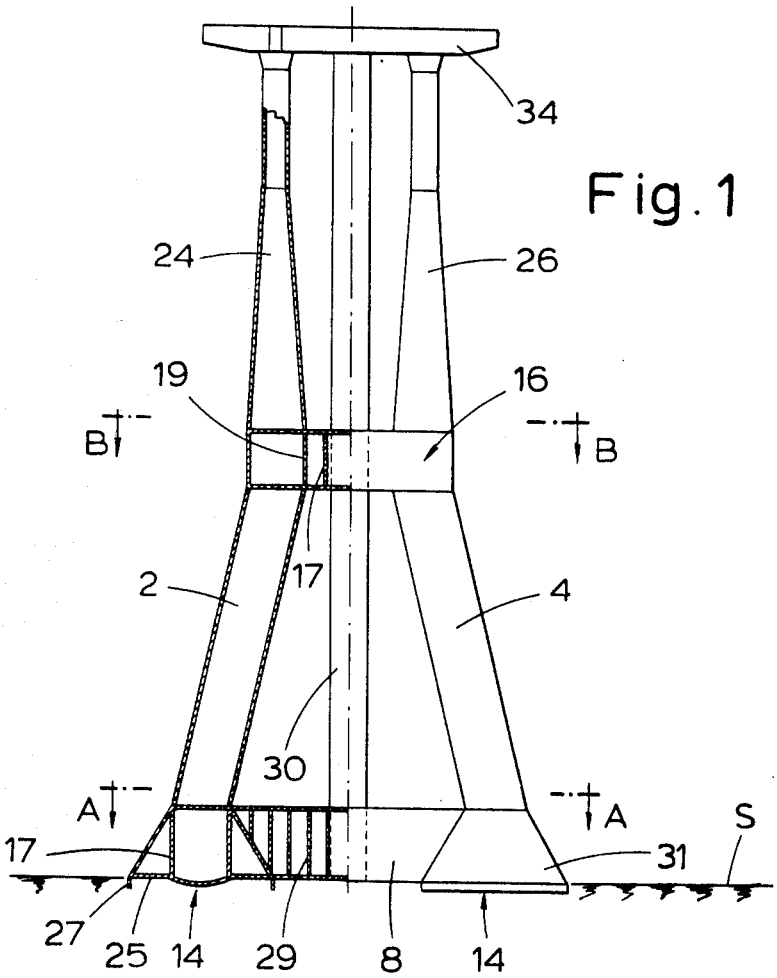
FIG. 1 is showing a lateral view — partly in section — of the structure in accordance with the invention.

As it appears from the accompanying drawings, the foundation structure in accordance with the invention comprises an upper and a lower set of column units being connected together with an intertie. The shown embodiment comprises three columns arranged in the corners of an equilateral triangle and including three inclined lower column legs 2,4,6, which lowermost are rigidly interconnected with three hollow girders or beams 8,10 and 12, and which at the bottom otherwise are provided with a special footing construction 14. Uppermost these inclined columns are integrally and rigidly connected to the intertie 16 which in the shown embodiment comprises three integrally joined closed hollow girders 18,20,22. (See FIG. 3). This intertieing structure should have a such overall size and a such volume relative to the columns that the intertie in substantial degree contributes to the buoyancy and stability of the entire foundation structure, particularly when same is in upright position. The free internal space in the intertie 16 may be divided up by means of cross-walls 17 (indicated in FIG. 1), in order to render this structure the required strength, particularly against buckling loads. The cylindrical walls of the column legs 24,26,28, located above the intertie may optionally be continued down through the intertie as an additional or separate wall structure therein. If this version is selected, an outer sector of the wall in the intertie in each corner thereof will suitably constitute a flush extension of the directly above located column wall, while the remaining sector of this column wall will constitute a separate wall structure extending down through the intertie as indicated with reference number 19 in FIGS. 1 and 2. The inside space in the intertie may thus be divided up into a number of tanks which may be utilized in a system for trimming of the foundation structure when floating in upright position.

Figure 2:
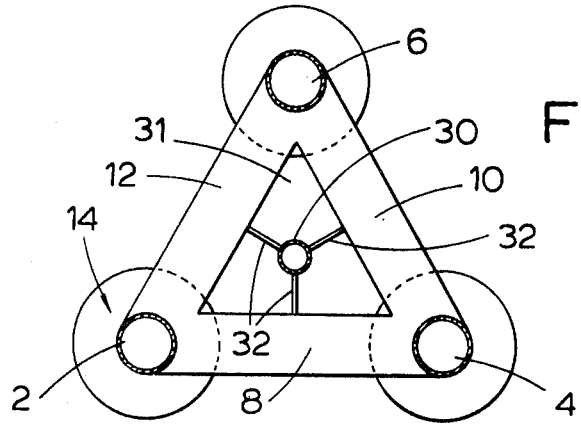
FIG. 2 is showing a schematic plan view along the plane A—A shown in FIG. 1.
Figure 3:
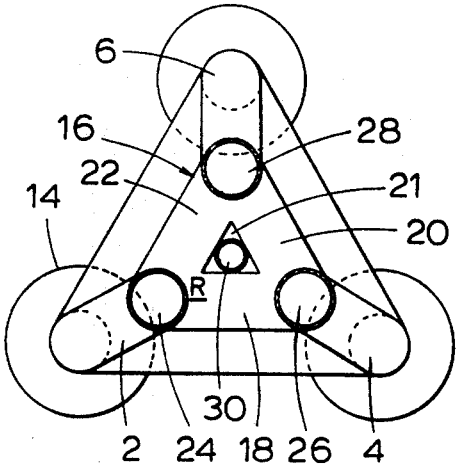
FIG. 3 is showing a schematic plan view along plane B—B in FIG. 1.

As shown in FIG. 1 and FIG. 3, showing a schematic plan view along the plane B—B in FIG. 1, the intertie construction comprises a platform or box structure composed of three box girders 18,20,22, which may have equal width and height, i.e. a square cross-sectional shape but in any case a sufficient width such that a part or zone R of the horizontal top and bottom "floor" of the intertie extends inside of the column junction leaving a centrally located equilateral triangle opening 21. (See FIG. 3). The inclined column legs located below the intertie may be given slightly elliptical cross-section in order to present a circular cross-section along the horizontal plane in order to facilitate the junction to the intertie.

The vertical columns 24,26,28, above the intertie may constitute direct vertical continuations of the column legs located below the intertie, such as shown in FIG. 1. Principally, however, it is not necessary to use the same number of column legs located above as below the intertie, but this will in most applications prove the best solution. The vertical columns above the intertie are preferably tapered towards the top such as shown in FIG. 1, and furthermore such that an uppermost section of these columns, for instance the last 20 meters, extending above sea level up to the working platform 34 are made as regular cylinders. The intertie should preferably divide the entire foundation structure into two equally tall parts. The shown embodiment is designed for a sea depth of approximately 250 meters. The intertie is designed to extend with its upper wall about 150 meters from the bottom of the footing construction such that the distance from the top side of the intertie to the platform will be approximately 135 meters. Calculations and model trials have shown that this foundation structure attains sufficient stability provided the distance from centre to centre in each of the three footing structures are calculated to approximately 100 meters. This centre to centre distance may at the intertie be reduced to approximately half this distance, that is 50 meters, which distance then corresponds to the centre distance between the upper vertical columns. On top of these columns one can then locate a working platform having sides of approximately 100 meters.

The box girders interconnecting the foot portions of the lower column legs are preferably designed upon the same principles as the intertie structure 16 and thus comprising three box girders 8,10 and 12 being directly interconnected at the corners thus forming a structurally self-contained structure. At the bottom of each inclined column leg 2,4,6, these are extended with a vertical column section 17 having the same height as the height of the adjacent box girder construction and integrally moulded to same. Furthermore, the fundament structure comprises frusto-conical footings 31, the conical side walls of which are smoothly joined to the adjacent box girders 8,10 and 12 and which furthermore are provided with tight bottom walls 25 shown in FIG. 1. The box girders 8,10 and 12 may furthermore be provided with a plurality of vertical partition walls 29. At the lower edge of the frusto-conical footings 31 are provided skirts 27 ment to be imbedded down into the sea floor S. Likewise the intertie 16, also the box girders 8,10 and 12 at the bottom of the structure will circumscribe an equilateral centre opening **21*b*. It will be understood that the entire foundation structure will constitute a very rigid open frame structure. By having inclined columns below the intertie 16 and utilizing frusto-conical footings 31** and furthermore by utilizing vertical columns above the intertie, one obtains altogether a structure able to sustain very large horizontally directed forces and loads. The inclination of the sloped columns can be varied in accordance with the needs.

Along the vertical centre line of the structure is in the shown embodiment located a through-going conductor column or pipe 30 which may or may not form part of the supporting or load sustaining structure. Usually it only shall serve as conductor and support for operational equipment, such as pipelines, drilling equipment, etc. The conductor pipe 30 can be given a diameter conforming to the triangular opening through the intertie 16 and may at the bottom of the structure be supported by interties 32 biased on the inside wall of the box girders 8,10 and 12.

Figure 4:
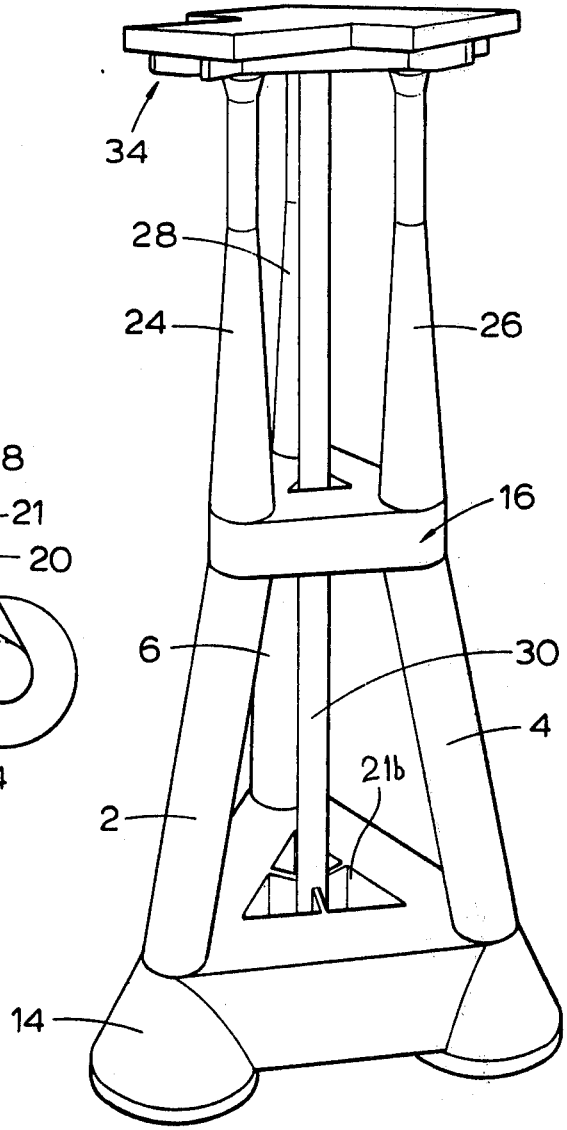
FIG. 4 is showing a perspective view of the structure when located in an offshore location.

FIG. 4 is a perspective view of the entire foundation structure and which illustrates the general overall design.

As outlined the intertie structure 16 serves several important functions. During the floating and towing operation to the site of location the intertie serves as buoyancy and stability means, especially when the structure shall be erected and lowered down to its location on the sea bottom. The towing operation from the building site to the site of location can take place in two fashions. In accordance with the preferred fashion the structure is towed out in upright position during which the upper wall of the intertie 16 usually will run flush with the sea surface, or, secondly, the structure may be towed out in horizontal or laid down position. In either case the intertie 16 and also the box girders 8,10 and 12 at the bottom of the structure will form important buoyancy and stability functions. When bringing the structure from horizontal to upright position the bottom girders 8,10 and 12 are being filled with water, having into effect that the structure will raise, having an axis of rotation extending approximately through the intertie 16. Thereafter the intertie 16 and the upper columns 24,26,28, are gradually being filled with water until the entire structure is seated on the sea bottom.

A very important quality of the foundation structure in accordance with the invention is that it will have a very low natural frequency or natural period even when the structure is located on comparatively large sea depths, for instance 200 to 400 meters. A low natural period is in fact not only a desirable but a rather decisive property of a such structure. A comparatively high natural period has proved to be a very serious shortcoming in several known platform and foundation constructions. The reason for that the structure in accordance with the invention has a low natural period is very closely connected to the large rigidity of the open frame "light build" structure in accordance with the invention. Calculations and model tests have shown that prevailing normal forces will primarily be introduced in the sloped columns. Calculations have furthermore shown that the raw material consumption in a structure in accordance with the invention will be substantially less than the material consumption if one should utilize known building principles.

A further advantage with the structure in accordance with the invention rests in that it can be utilized for various sea depths. As previously mentioned, one may within a certain depth range vary the depth of the upper vertical columns in order to adapt the structure to any existing sea depth within this range.

We claim:

1. An open frame offshore foundation structure made of concrete to be firmly but removably located on a working site on the sea floor, comprising, a lower set of bouyant but ballastable columns inclined towards each other in direction upwards and provided at their lower ends with laterally enlarged footings to be biased on the sea floor, said footings being rigidly interconnected with lateral stiffeners, a bouyant but ballastable intertie box structure rigidly receiving the tops of said inclined columns, and comprising an integral unit of closed box girders, each having a width greater than the cross-section of the lower columns where they are connected to the intertie box structure, said intertie box structure defining a through-going opening in its center, and an upper vertical bouyant but ballastable column unit, the lower end of which is rigidly supported on said intertie box structure and the upper end of which is for supporting a working platform above sea level, the width of said closed box girders being greater then the cross-section of the columns of said column unit where they are connected to the intertie box structure.

2. An open frame offshore foundation structure in accordance with claim 1, in which the lower set of inclined columns comprises three columns, each centre of which is located in the corner of an equilateral triangle.

3. An open frame offshore foundation structure in accordance with claim 1, said columns being circular, wherein a lower part of the walls of the upper columns are extended down through the intertie box structure to the bottom wall thereof, one sector part of said walls being common with an adjacent wall of the intertie, the remaning sector of same extending as a separate wall through the interior of the intertie box structure.

4. An open frame offshore foundation structure in accordance with claim 1, said lower and said upper sets of columns each comprising a set with three columns, each centre of which is located in the corner of an equilateral triangle.

5. An open frame offshore foundation structure in accordance with claim 1, said footings on the lower columns comprising generally frusto-conical bodies with the larger end designed to rest onto the sea floor, said lateral stiffeners at the bottom of the lower columns integrally joined with the frusto-conical footings.

6. An open frame offshore foundation structure in accordance with claim 5, in which said lateral stiffeners each comprises a box girder, which girders are in part directly joined together at the meeting ends, and in part are integrally joined to one of said frusto-conical footings.

7. An open frame offshore foundation structure in accordance with claim 1, said structure provided with a vertical centrally located conductor pipe or column, extending from the working platform and down through the intertie structure and to the sea floor.

8. An open frame offshore foundation structure in accordance with claim 1, said intertie box structure being dimensioned and having an internal volume capacity to provide a substantial increase in the buoyancy to the entire structure.

9. An open frame offshore foundation structure in accordance with claim 1, said lower columns, said intertie box structure and said upper columns constituting stabilizing buoyancy means.

* * * * *